US008146540B2

(12) United States Patent
Effert et al.

(10) Patent No.: US 8,146,540 B2
(45) Date of Patent: Apr. 3, 2012

(54) CONTINUOUS STEAM GENERATOR

(75) Inventors: Martin Effert, Erlangen (DE); Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 562 days.

(21) Appl. No.: 11/884,286

(22) PCT Filed: Feb. 6, 2006

(86) PCT No.: PCT/EP2006/050688

§ 371 (c)(1),
(2), (4) Date: Aug. 14, 2007

(87) PCT Pub. No.: WO2006/087272

PCT Pub. Date: Aug. 24, 2006

(65) Prior Publication Data

US 2008/0115743 A1 May 22, 2008

(30) Foreign Application Priority Data

Feb. 16, 2005 (EP) ..... 05003267

(51) Int. Cl.
*F22B 29/06* (2006.01)
*F22B 37/26* (2006.01)

(52) U.S. Cl. .... 122/7 R; 122/1 B; 122/406.4; 122/406.1

(58) Field of Classification Search ..... 122/1 B, 122/7 R, 406.1, 406.4
See application file for complete search history.

(56) References Cited

U.S. PATENT DOCUMENTS

| | | | | |
|---|---|---|---|---|
| 3,633,344 | A | 1/1972 | Blank et al. | |
| 3,789,806 | A | 2/1974 | Gorzegno | |
| 4,205,633 | A * | 6/1980 | Wittchow | 122/406.4 |
| 4,232,635 | A * | 11/1980 | Losel | 122/406.5 |
| 5,735,236 | A * | 4/1998 | Kastner et al. | 122/6 A |
| 5,924,389 | A * | 7/1999 | Palkes et al. | 122/7 R |
| 5,976,207 | A * | 11/1999 | Vollmer | 55/309 |
| 5,979,369 | A * | 11/1999 | Wittchow et al. | 122/235.12 |
| 5,983,639 | A * | 11/1999 | Kral et al. | 60/646 |
| 6,206,685 | B1 * | 3/2001 | Zamansky et al. | 431/4 |

FOREIGN PATENT DOCUMENTS

| | | |
|---|---|---|
| DE | 42 42 144 A1 | 6/1994 |
| GB | 746 459 A | 3/1956 |
| GB | 1 202 780 | 8/1970 |

* cited by examiner

*Primary Examiner* — Steven B McAllister
*Assistant Examiner* — Seth Greenia

(57) ABSTRACT

The invention relates to a continuous steam generator comprising a surrounding wall which forms a gas draught and whose lower section is configured from gas-tight evaporator tubes that are welded together and whose upper section is configured from gas-tight superheater tubes that are welded together. According to the invention, superheater tubes are connected downstream of the evaporator tubes on the flow medium side by means of a water separator system. The aim of the invention is to provide a system with particularly high degree of operational flexibility even in the start-up and off-peak periods, while keeping the production and installation expenditure relatively low. To achieve this, the water separator system comprises a large number of water separator elements, each of which is connected downstream or upstream of less than ten evaporator tubes, preferably one tube and/or less than ten superheater tubes, preferably one tube on the flow medium side.

10 Claims, 3 Drawing Sheets

CONTINUOUS STEAM GENERATOR

CROSS REFERENCE TO RELATED APPLICATIONS

This application is the US National Stage of International Application No. PCT/EP2006/050688, filed Feb. 6, 2006 and claims the benefit thereof. The International Application claims the benefits of European application No. 05003267.1 filed Feb. 16, 2005, both of the applications are incorporated by reference herein in their entirety.

FIELD OF INVENTION

The invention relates to a continuous steam generator comprising a surrounding wall which forms a gas draught of which the lower section is configured from gas-tight evaporator tubes that are welded together and of which the upper section is configured from gas-tight superheater tubes that are welded together, with the superheater tubes being connected downstream of the evaporator tubes on the flow medium side by means of a water separator system.

BACKGROUND OF THE INVENTION

In a continuous steam generator the heating up a number of evaporator tubes which together form this gas-tight surrounding wall of a combustion chamber leads to a complete evaporation of the flow medium in the evaporation tubes in one pass. The flow medium—usually water—is fed after its evaporation to the superheater tubes connected downstream of the evaporator tubes and is superheated there. The position of the evaporation end point, i.e. the boundary area between unevaporated and evaporated flow medium, is variable and dependent on operating mode in this case. In full-load operation of this type of continuous steam generator the evaporation end point lies for example in an end area of the evaporation tubes so that the superheating of the evaporated flow medium already begins in the evaporator tubes. By contrast with a natural or forced-circulation steam generator, a continuous steam generator is not subject to any pressure limitation, so that it can be designed for fresh steam pressures far above the critical pressure of water ($P_{crit}$≈221 bar)—where no distinction of the phases water and steam and thus no phase separation either is possible.

In off-peak operation or during start-up this type of continuous steam generator is usually operated with a minimum flow of flow medium in the evaporator tubes in order to guarantee a safe cooling of the evaporator tubes. To this end, even with low loads of for example less than 40%, the design load of the pure mass throughflow through the evaporation is generally no longer sufficient for cooling the evaporator tubes, so that the throughflow of flow medium circulated through the evaporator is overlaid with an additional throughflow of flow medium. The operational minimum flow of flow medium provided in the evaporator tubes is thus not completely evaporated in the evaporator tubes during start-up or in off-peak operation, so that with this type of operating mode there is still unevaporated flow medium, especially a mixture of water and steam, present at the end of the evaporator tubes.

Since the superheater tubes usually connected downstream of the evaporator tubes of the continuous steam generator only once the flow medium has passed through the walls of the combustion chamber are however not designed for a throughflow of unevaporated flow medium, continuous steam generators are usually designed so that, on start-up and in off-peak operation, entry of water into the superheater tubes is securely avoided. To this end the evaporator tubes are usually connected to the superheater tubes downstream from them via a water separator system. The water separator in this case effects a separation into water and steam of the water-steam mixture coming out of the evaporator tubes during start-up or off-peak operation. The steam is fed to the superheater tubes connected downstream from the water separator, whereas the separated water can for example be fed back into the evaporator tubes via a recirculation pump or discharged via a pressure relief device. A continuous steam generator of the design mentioned above is known for example from DE 197 02 133 A1.

With this type of continuous steam generator the evaporator tubes forming the lower part of the surrounding wall of the gas draught usually open out into one or more outlet collectors from which the flow medium is directed into a downstream water-steam separator. In this device the flow medium is separated into water and steam, with the steam being transferred into a distribution system connected upstream of the superheater tubes, where a distribution of the steam mass flow to the individual flow medium-side parallel-connected superheater tubes is undertaken.

In this type of construction the evaporation end point of the continuous steam generator is fixed by the intermediate connection of the water separator system in start-up and off-peak operation and not—as in full-load operation—variable. This means that the operational flexibility when the continuous steam generator is constructed in this way is significantly restricted in off-peak operation. Furthermore, with this type of construction, the separator systems must as a rule, especially as regards the choice of material, be designed so that the steam in the separator or in pure continuous mode is significantly overheated. The necessary choice of material also leads to a significant restriction in operational flexibility. As regards the dimensioning and type of construction of the components required, said construction also requires that the water escaping during start up of the continuous steam generator in a first start-up phase must be completely captured in the separator system and must be able to be discharged via the downstream separator vessel and the outlet valves into the pressure relief unit. The resulting comparatively large dimensioning of separator vessel and outlet valves leads to a significant outlay in manufacturing and installation.

SUMMARY OF INVENTION

The underlying object of the invention is thus to specify a continuous steam generator of the type mentioned above which, while keeping production and installation outlay low, also has an especially high operational flexibility even during start-up and off-peak operation.

In accordance with the invention this object is achieved by the water separator system comprising a large number of water separator elements, each of which is connected downstream or upstream of fewer than ten evaporator tubes, preferably a single tube and/or of fewer than ten superheater tubes, preferably a single tube, on the flow medium side.

The invention is based here on the idea that the continuous steam generator, to guarantee an especially high operational flexibility even in start-up or off-peak operation, should be designed for a variable evaporation end point. To this end the fixing of the evaporation end point in the water separator system usual with previous systems is to be avoided. As regards the knowledge that this fixing essentially arises by the collection of the flow medium flowing out of the evaporator tubes, the subsequent water separation in a central water separator device and then the distribution of the steam to the superheater tubes, a decentralization of the water separation function is to be undertaken. The water separation should in this case especially be designed to avoid any overcomplexity in the distribution of the flow medium after the water separation, since it is precisely this aspect which is not practicable for a water-steam mixture. This can be achieved by the evaporator tubes and/or superheater tubes being assigned individual water separator elements or elements collected into small groups.

The surrounding wall of the gas draught can in this case be embodied with vertical tubes or also wound in a spiral shape. With a vertically-tubed combustion chamber the number of superheater tubes in particular can be selected so that each superheater tube can be individually connected downstream from an evaporator tube via an intermediate water separator element in the sense of a one-to-one assignment. With an arrangement of this kind, without any necessity for a redistribution of flow medium on transition from the evaporator tube into the superheated tube, it is possible in a particularly simple manner to have a displacement of the evaporation end point on demand from the evaporation tube into the respective downstream superheater tube. Especially when the combustion chamber has a spiral-wound construction, the number of evaporator tubes can however also be selected to be smaller than the number of the—preferably vertically arranged—superheater tubes. With this type of embodiment a plurality of superheater tubes, for example three superheater tubes, can be connected downstream from each evaporator tube via an assigned water separator element.

The decentralized water separation in the individual tube made possible by the water separator elements assigned individually or in smaller groups to the evaporator and/or superheater tubes guarantees that in normal operating states the evaporation end point can be relocated from the evaporator tubes into the downstream superheater tubes. This type of embodiment in particular makes it possible for the spatial transition area from the evaporator tubes into the superheater tubes in the surrounding wall of the continuous steam generator to be able to be moved comparatively far down, i.e. as far as the burners arranged in the area of the evaporator tubes in the surrounding wall. This enables the part of the surrounding wall of the continuous steam generator operated in start-up or off-peak mode with an overlaid circulation to be kept comparatively small and in particular within the range of actual requirements, i.e. the area of comparatively high heat flow densities in the immediate environment of the burner to be restricted. This means that the total overlaid circulation required is able to be provided while keeping the outlay comparatively low. To this end the water separator elements are advantageously positioned at a height of up to 20 m above the respective uppermost burner in the surrounding wall.

An especially simple construction of the water separator elements with high reliability of water separation can be achieved by the respective water separator element advantageously being designed for an inertial separation of the water from the steam in the flow medium. This preferably makes use of the knowledge that the water component of the flow medium, on account of its greater inertia compared to the steam component, preferably flows forward in a straight line in its direction of flow, whereas the steam component is comparatively better able to follow a forced diversion. To utilize this with a high separation effect for a comparatively simple construction of the water separator element, this is embodied in an especially advantageous design in the shape of a T-piece. In this case the respective water separator element preferably includes an admission tube section connected to the upstream evaporator tube, which viewed in its longitudinal direction turns into a water separator tube piece, with a number of outflow tube sections connected to the downstream superheater tube branching off in the transition area. The water component of the flow medium flowing into the admission tube section will in this case, as a result of its comparatively high inertia at the branching-off point, essentially be further transported without diversion in the longitudinal direction and thus transferred into the water drain tube section. By contrast a diversion is more easily possible for the steam component as a result of its comparatively low inertia, so that the steam component passes into the branching-off outflow tube section or sections.

Preferably the admission tube section is essentially designed as a straight section, with the section being able to be arranged in its longitudinal direction essentially horizontally or also at a predetermined angle of inclination or tilt. In this case an inclination in the flow direction upwards is preferably provided. Alternatively an inwards flow of the admission tube section can be provided via an angled tube coming from above so that in this case the flow medium will be pressed as a result of centrifugal force in the direction of the outside of the bend. This means that the water component of the flow medium preferably flows along the outside area of the bend. With this embodiment the outflow tube section provided for discharging the steam component is thus preferably aligned towards the inside of the bend.

The drain tube section is preferably embodied in its entry area as a curved tube bent downwards. This means that a diversion of the separated water for appropriate feeding into subsequent systems is facilitated in an especially simple and low-loss manner.

Advantageously the water separator elements are connected on the water output side i.e. especially with their water drain tube sections, in groups to a number of shared outlet manifolds In particular in these cases an outlet manifold can be provided for each side wall of the gas draught to which the water separator elements of the respective sidewall are connected. With this type of connection, by contrast with conventional systems in which on the flow medium side the water separator is connected downstream from the outlet manifolds of the evaporator tubes, the respective water separator element is now connected upstream from the outlet manifold. It is precisely this that makes direct transfer of the flow medium from the evaporator tubes into the superheater tubes without intermediate connection of collector or distributor systems possible even in a start-up or off-peak operation, so that the evaporation end point can also be displaced into the superheater tubes. A number of water collection containers are advantageously connected downstream from the outlet manifolds in this case. The water collection container or containers can in this case be connected for their part on the output side to suitable systems such as for example an atmospheric pressure relief unit or via a recirculation pump to the circuit of the continuous steam generator.

For the separation of water and steam in the water separator system either almost the entire water component can be separated so that only evaporated flow medium is transferred to the downstream superheater tubes. In this case the evaporation end point still lies in the evaporator tubes. Alternatively however also only a part of the water occurring can be separated with the remaining still unevaporated flow medium being passed on together with the evaporated flow medium to the downstream superheater tubes. In this case the evaporation end point is displaced into the superheater tube.

In the last-mentioned case, also referred to as overfeeding of the separator device, the components such as for example outlet manifold or water collection container connected downstream on the water side from the water separator elements are initially completely filled with water so that with further inflowing water back-pressure occurs in the corresponding tube sections. As soon as this back-pressure has reached the water separator elements at least a part flow of new inflowing water together with the steam carried in the flow medium is passed on to the downstream superheater tubes. To guarantee particularly high operational flexibility in this operating mode of so-called overfeeding of the separator system, in an especially advantageous embodiment an adjustment valve is connected to an outflow line connected to the water collection container via an assigned closed-loop control device. The closed-loop control device in this case is advantageously able to be supplied with a characteristic input value for the enthalpy of the flow medium at the flue gas-side end of the surrounding wall formed by superheater surfaces.

Such a system, in the operating mode of the overfed separator system, by explicit control of the valve connected into the outflow line of the water collection container, enables the mass flow flowing out of the water collection container to be adjusted. Since this is replaced by a corresponding water mass flow from the water separator elements the mass flow reaching at the collection system from the water separator elements can also be adjusted. This again means that it is possible to adjust that part flow which is passed on together with the steam into the superheater tubes so that, by using a corresponding adjustment of this part flow, a predetermined enthalpy can be maintained for example at the end of the heat surfaces downstream from the combustion chamber walls. As an alternative or in addition the hot water flow passed on together with the steam into the superheater tubes can also be influenced by a corresponding control of the overlaid recirculation. To this end, in a further alternative advantageous embodiment, a recirculation pump assigned to the evaporator tubes can be controlled via the closed-loop control device assigned to the water separator device.

The advantages obtained with the invention consist especially in the integration of the water separation into the tube system of the continuous steam generator, allowing the water separation to be undertaken without previous collection of the flow medium flowing out of the evaporator tubes and without subsequent distribution to the superheater tubes of the flow medium to be passed on to the superheater tubes. This obviates the need for collection and distribution systems. Doing without expensive distribution systems also means that the transfer of the flow medium to the superheater tubes is no longer restricted to steam; instead a water-steam a mixture can be passed on to the superheater tubes. For this reason precisely the evaporation end point can be moved beyond the separation point between evaporator tubes and superheater tubes into the superheater tubes if necessary. This enables an especially high operational flexibility to be achieved even in the start-up or off-peak operation of the continuous steam generator. The continuous steam generator is also especially suitable for a comparatively large power station unit with an electrical output of more than 100 MW.

In addition the water separator elements can be embodied especially as T-pieces on the basis of the pipework of the continuous steam generator present in any event. These T-pieces can be embodied with comparatively thin walls, with diameter and wall strength being able to be kept to appr. the same as that of the wall tubes. This means that the thin-wall embodiment of the water separator element does not further limit the start-up times of the vessel as a whole or also the load change speeds, so that it even in systems for high steam states comparatively short reaction times are achievable on changes in load. In addition these types of T-pieces can be manufactured at especially low cost. In addition, by arranging the separator system at a comparatively low height above the burners, the proportion of heat surfaces filled with water when the vessel is started up can be kept small so that the water ejection arising on start up and the associated losses can be kept particularly small. In particular an interim overfeeding of the separator elements on start-up or in off-peak mode is permitted so that a part of the evaporator water to be expelled can be captured in the superheater tubes connected downstream from the evaporator tubes. This means that the water collection systems such as the separator vessels or the outlet valves for example can be designed for correspondingly smaller outflow volumes and thereby more cost effectively. Furthermore the displacement of the evaporation end point into the superheater tubes allows any possible injection of water that may be required and the associated losses to be limited.

BRIEF DESCRIPTION OF THE DRAWINGS

An exemplary embodiment of the invention is explained in more detail below with reference to a drawing. The figures show.

DETAILED DESCRIPTION OF INVENTION

The same parts are shown by the same reference symbols in all the figures.

Figure 1:
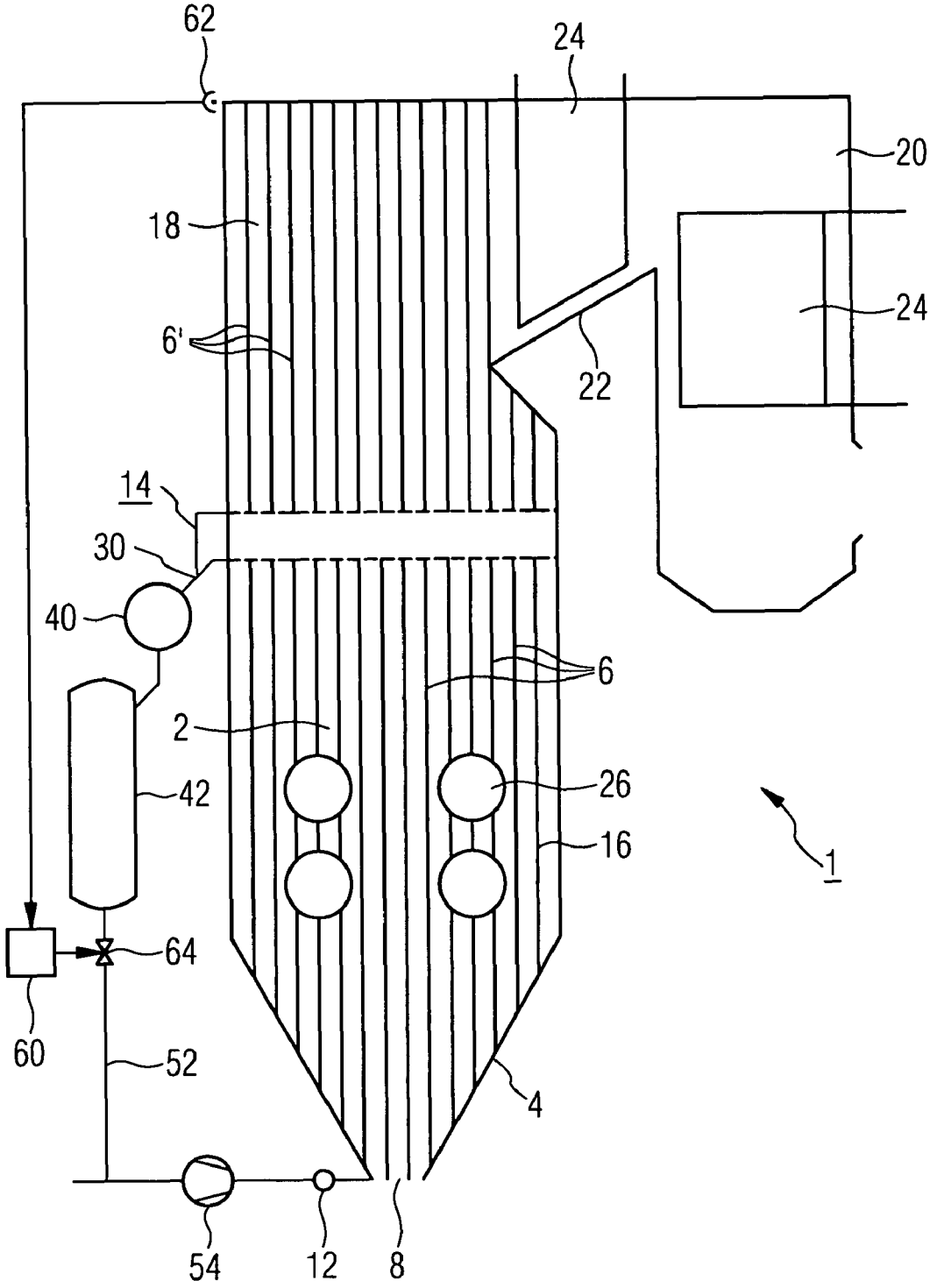
FIG. 1 a schematic diagram of a continuous steam generator constructed in a vertical design.

The continuous steam generator 1 in accordance with FIG. 1 is embodied as a vertical design and as a two-draught steam generator. It features a surrounding wall 2 which, at the lower end of the first gas draught formed by it, turns into a funnel-shaped base section 4. The surrounding wall 2 is constructed in a lower area or evaporator area from evaporator tubes 6 and in an upper area or superheater area from superheater tubes 6'. The evaporator tubes 6 or the superheater tubes 6' are connected to each other in a gas-tight manner on their longitudinal sides, for example welded to each other. The base 4 includes a discharge opening 8 for ash, not shown in any greater detail in the diagram.

The evaporator tubes 6 of the surrounding wall 2 through which a flow medium, especially water or a water-steam mixture, flows from bottom to top are connected with their inlet ends to an inlet manifold 12. On the outlet side the evaporator tubes are connected via a water separator system 14 to the subsequent downstream superheater tubes 6' on the flow medium side.

The evaporator tubes 6 of the surrounding wall form an evaporator heating surface 16 in the section of the gas draught located between the entry manifold 12 and the water separator system 14. Connected to this is a reheating or superheating surface 18 formed by the superheater tubes 6'. In addition, in the second gas draught 20 through which the heating gases flow downwards and in the transverse draught 22 connecting this heating gas draught to the first gas draught there are arranged further heating surfaces 24 only shown schematically, for example an economizer and convective superheater surfaces.

Accommodated in the lower area of the surrounding wall 2 are a number of burners for a fossil fuel, each in an opening 26 of the surrounding wall 2. Four openings 26 can be seen in FIG. 1. At this type of opening 26 the evaporator tubes 6 of the surrounding wall 2 are bent to get around the respective opening 26 and run on the outer side of the vertical gas draught. These openings can for example also be provided for air nozzles.

The continuous steam generator 1 is designed so that even in start-up or off-peak mode, in which the evaporator tubes, in addition to the evaporable mass flow of flow medium, for reasons of operational safety are also overlaid with a further recirculating mass flow of flow medium, the position of the evaporation end point can be kept flexible for an especially high level of operational flexibility. To this end the evaporation end point in start-up and off-peak mode, in which as a result of the design the flow medium is not yet completely evaporated at the end of the evaporator tubes 6, is to be moved into the superheater tubes 6'. To achieve this, the water separator system 14, is designed so that no complicated distribution of the water-steam mixture to the superheater tubes 6' is required after the water-steam separation. To make this possible the water separation system 14 features a plurality of water separator elements 30, of which each is connected in the exemplary embodiment downstream or upstream of a single evaporator tuber 6 and a single superheater tube 6' on the flow medium side. Alternatively the assignment of evaporator tubes 6 and/or superheater tubes 6' to individual water separator elements 30 could however also be undertaken in groups so that a maximum of ten evaporator tubes 6 and/or superheater tubes 6' are connected to a shared water separator element 30.

In the exemplary embodiment the water separator elements 30, of which only one is visible in FIG. 1, are arranged however so that, in the sense of a one-to-one assignment, each evaporator tube 6 is connected to exactly one subsequent superheater tube 6' so that in terms of function and circuit technology the water separation is relocated into the individual tubes. This guarantees that in conjunction with water-steam separation, neither a collection of a flow medium flowing out of the evaporator tubes 6 nor a distribution of the flow medium to be passed on to the subsequent superheater tubes 6' is required. This enables the evaporation end point to be relocated into the superheater tubes 6' in a particularly simple manner. As has been shown however, in terms of flow dynamics, a passing on of the water-steam mixture to the superheater tubes 6' is also possible if it is distributed to not more than around ten superheater tubes 6'.

Figure 2:
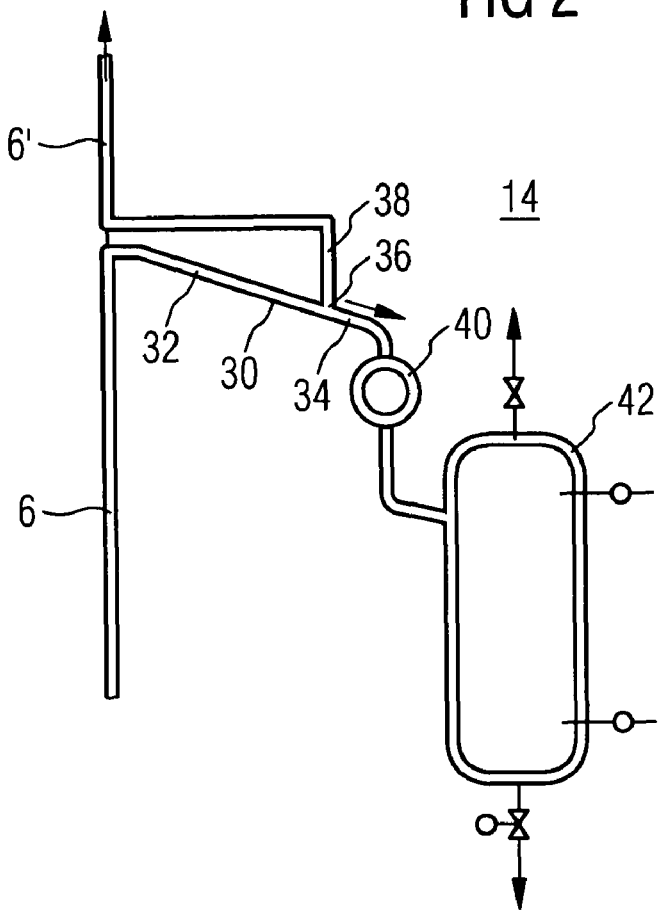
FIG. 2 sections through a water separator system of the continuous steam generator depicted in FIG. 1 and FIG. 3A-3D a water separator element.

The water separation system 14, of which sections are reproduced in enlarged form in FIG. 2, thus includes a number of water separator elements 30 corresponding to the number of evaporator tubes 6 and superheater tubes 6', of which each is embodied in the form of a T-shaped tube section. In this case the respective water separator element 30 includes an admission tube section 32 connected to the upstream evaporator tube 6, that, viewed in its longitudinal direction turns into a water drain tube section 34, with an outflow tube section 38 connected to the downstream superheater tube 6' branching off where the two sections meet. This construction means that the water separator element 30 is designed for an inertia separation of the water-steam mixture flowing out of the upstream evaporator tube 6 into the admission tube section 32. Because of its comparatively high inertia the water component of the flow medium flowing into the admission tube section 32 naturally flows at the transition point 36 preferably in an axial extension of the admission tube section 32 straight on and thus arrives at the water drain tube section 34. The steam component of the water-steam mixture flowing into the admission tube section 32 can by contrast, as a result of its comparatively low inertia, better follow a forced rerouting following and thus flows via the outflow tube section 38 to the downstream superheater tube section 6'.

On the water output side. i.e. via the water drain tube sections 34, the water separator elements 30 are connected in groups in each case to a common outlet manifold 40, with a separate outlet manifold 40 being provided for each side wall of the gas draught. The outlet manifolds 40 are connected on the output side in their turn to a common water collector container 42, especially a separator vessel.

Figure 3A:
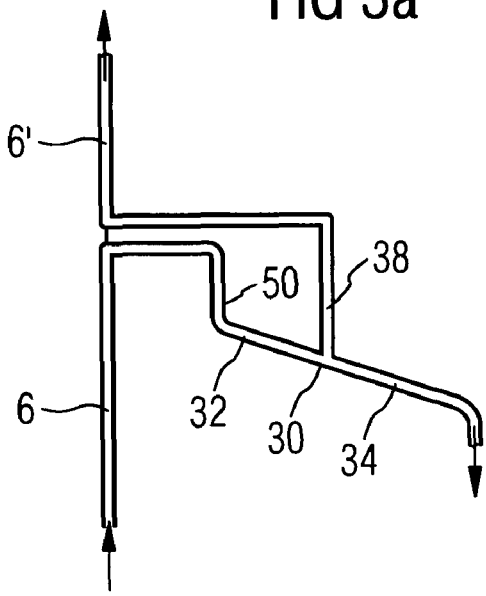

The design of the water separator elements 30 embodied as T-shaped tube sections can be optimized in respect of their separation effect. Exemplary embodiments of this can be found in FIG. 3A to 3D. As shown in FIG. 3A, the admission tube section 32 can be embodied jointly with the water drain tube section 34 which follows as an essentially linear section and with its longitudinal direction inclined to the horizontal. In the exemplary embodiment according to FIG. 3A admission tube section 32 has an additional knee-shaped bent tube section 50 connected upstream from it, which, by virtue of its bending and its spatial arrangement, has the effect of pressing water flowing into the admission tube section 32 as a result of centrifugal force preferably onto the inner wall side of the admission tube section 32 and water drain tube section 34 lying opposite the outflow tube section 38. This facilitates the onward transport of the water component into the water drain tube section 34, so that the separation effect increases overall.

Figure 3B:
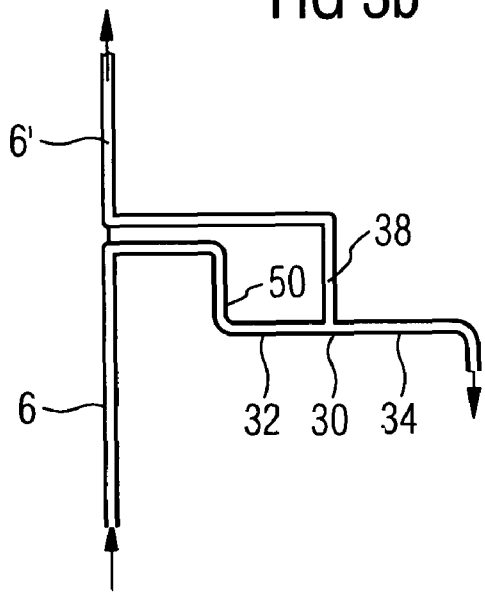

A similar amplification of the separation effect is, as is shown in FIG. 3B also achievable if admission tube section 32 and water drain tube section 34 are essentially horizontally aligned, by a suitable bent routed tube section 50 also being connected upstream.

Figure 3C:
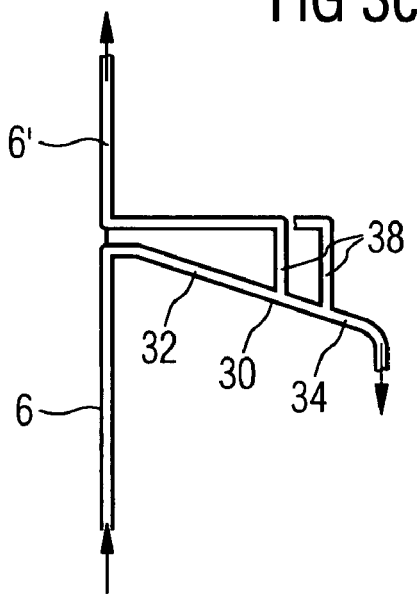
Figure 3D:
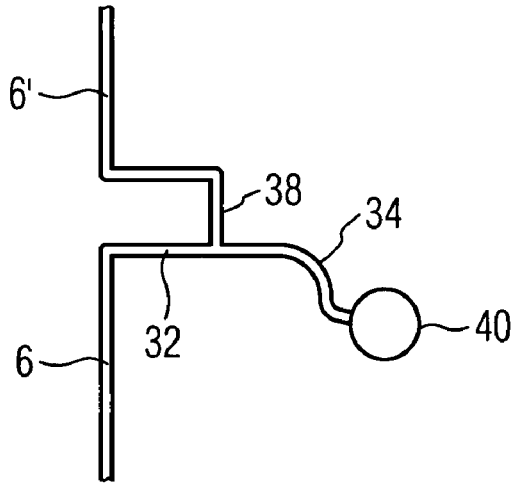

FIG. 3C shows an exemplary embodiment of the water separator element 30 connecting a single upstream evaporator tube 6 to a plurality of downstream superheater tubes 6' in the exemplary embodiment 2. To this end two outflow tube sections 38 branch off in the exemplary embodiment shown in FIG. 3C from the media channel formed by the admission tube section 32 and the water drain tube section 34, with each of said outflow tube sections being connected to a downstream superheater tube 6'. To facilitate the inflow of the separated water into the downstream outlet manifold 40, the outflow tube section 34—as shown in FIG. 3D—can be embodied as a curved tube bent downwards or as a correspondingly designed part section.

As can be seen in the diagram depicted in FIG. 1, the water collection container 42 is linked on its output side via a connected drain tube 52 and an economizer heating surface not shown in any greater detail to the inlet manifold 12 connected upstream of the evaporator tubes 6. This produces a closed circuit, via which in start-up or off-peak mode the flow medium flowing into the evaporator tubes 6 can be overlaid with an additional circulation to improve operational safety. Depending on operational requirements or demands the water separation system 14 can be operated in this case such that all water still carried at the exit from the evaporator tube 6 is separated from the flow medium and only evaporated flow medium is passed on to the superheater tubes 6'.

Alternatively the water separation system 14 can however also be operated in what is known as overfed mode, in which not all water is separated from the flow medium, but a part flow of the water carried is still passed on together with the steam to the superheater tubes 6'. In this operating mode the evaporation end point moves into the superheater tubes 6'. In this type of overfed mode initially both the water collection container 42 as also the upstream outlet manifold 40 completely fill with water, so that a back pressure forms into the transition area 36 of the respective water separator element 30 at which the outflow tube section 38 branches off. This back pressure also causes the water component of the flow medium flowing into the water separator elements 30 to at least undergo a rerouting and thus to reach the outflow tube section 38 together with the steam. The level of the partial flow, which is in this case is fed jointly with the steam to the superheater tubes 6', is produced in such cases on the one hand by the overall water mass flow directed to the respective water separator element 30 and on the other hand from the part mass flow discharged via the water drain tube section 34. Thus through suitable variation of the water mass flow supplied and/or of the water mass flow discharged via the water drain tube section 34, the mass flow of unevaporated flow medium can be directed into the superheater tubes 6'. It is thus possible, through activation of one or both of the said variables, to adjust the proportion of the unevaporated flow medium passed on to the superheater tubes 6' such that for example a predetermined enthalpy is set at the end of the superheater surface 18.

To make this possible a closed-loop control device 60 is assigned to the water separator system 14, which is connected on the input side to a measurement sensor 62 embodied for determination of a characteristic value for the enthalpy at the combustion gas end of the superheater surface 18. On the output side the closed-loop controller 60 operates on one side on an adjustment valve 64 connected into the outflow line 52 of the water collection container 42. This enables the water flow which is to be removed from the separator system 14 to be predetermined by explicit activation of the adjustment valve 64. This mass flow can in its turn be removed in the water separator elements 30 from the flow medium and passed on to the subsequent collection system. This means that, by activation of the adjustment valve 64, it is possible to influence the water flow branched off in the water separator element 30 in each case and thus the water component still passed on in the flow medium to the superheater surfaces 6' after the separation. As an alternative or in addition the closed-loop controller 60 can also operate on the recirculation pump 54, so that the inflow rate of the medium into the water separator system 14 can be set accordingly.

The invention claimed is:

1. A continuous steam generator, comprising:

a surrounding wall forming a gas draught where:

a lower area is formed from evaporator tubes welded to each other to form a gas-tight seal, and an upper area is formed from superheater tubes welded to each other to form a gas-tight seal; and a water separator system having a plurality of water separator elements where each element is connected downstream of fewer than ten evaporator tubes and upstream of fewer than ten superheater tubes on the input side of a water separator, from an evaporator, wherein a plurality of burners are arranged in the area of the evaporator tubes in the surrounding wall and the water separator elements are positioned at a height of not more than 20 m above the topmost burner;

and wherein an adjustment valve controlled by an assigned closed-loop control device is arranged in an outflow tube connected to at least one water collection container receiving fluid from the water separator system, the closed loop control device receiving a characteristic input value from a sensor for the enthalpy of the flow medium on the steam-side outlet of the superheater surface.

2. The continuous steam generator as claimed in claim 1, wherein the respective water separator element includes an admission tube section with the evaporator tubes connected upstream in each case which viewed in a longitudinal direction, turns into a water drain tube section, with a plurality of outflow tube sections connected to the downstream superheater tubes in each case branching off in a transition area.

3. The continuous steam generator as claimed in claim 2, wherein the inflow to the admission tube section is via a tube bend coming from above.

4. The continuous steam generator as claimed in claim 3, wherein the water drain tube section in the transition area is inclined downwards from the horizontal in the direction of flow.

5. The continuous steam generator as claimed in claim 4, wherein the water drain tube section is embodied in its admission area as a tube bend curved downwards.

6. The continuous steam generator as claimed in claim 5, wherein the water separator elements are connected in groups on the water output side to a plurality of shared outlet manifolds.

7. The continuous steam generator as claimed in claim 6, wherein downstream from the outlet manifolds are at least one water collection container.

8. The continuous steam generator as claimed in claim 1, wherein a recirculation pump assigned to the evaporator tubes is controlled via the closed-loop control device.

9. The continuous steam generator as claimed in claim 1, wherein each of the plurality of water separator elements is connected to a single evaporator tube and a single superheater tube.

10. A continuous steam generator, comprising:

a plurality of evaporator tubes arranged and welded adjacent to one another in a gas-tight manner to form a lower area of the gas draught where a flow medium enters the evaporator tubes and is at least partially evaporated;

a water separator system having a plurality of water separator elements connected to the plurality of evaporator tubes and the water separator system receives the at least partially evaporated flow medium and where each water separator element is connected downstream to less than ten evaporator tubes; and a plurality of superheater tubes arranged and welded adjacent to one another in a gas-tight manner to form an upper area of the gas draught and connected to the plurality of water separator elements where each water separator element is connected upstream to less than ten superheater tubes and where the plurality of superheater tubes receives the evaporated and separated flow medium and superheats the evaporated and separated flow medium, wherein a plurality of burners are arranged in the area of the evaporator tubes in the surrounding wall formed by the evaporator tubes and the water separator elements are positioned at a height of not more than 20 m above the topmost burner;

and wherein an adjustment valve controlled by an assigned closed-loop control device is arranged in an outflow tube connected to at least one water collection container receiving fluid from the water separator system, the closed loop control device receiving a characteristic input value from a sensor for the enthalpy of the flow medium on the steam-side outlet of the superheater surface.

* * * * *